US008420586B2

(12) United States Patent
Vinson et al.

(10) Patent No.: US 8,420,586 B2
(45) Date of Patent: Apr. 16, 2013

(54) THICKENED OVEN CLEANER COMPRISING A GLUTAMIC ACID SALT OR DISODIUM ETHANOL DIGLYCINE CHELANT

(75) Inventors: Thomas J. Vinson, Thomasville, NC (US); Karen O. Rigley, Greensboro, NC (US); Tami J. Tadrowski, Greensboro, NC (US)

(73) Assignee: Ecolab USA Inc., St. Paul, MN (US)

( * ) Notice: Subject to any disclaimer, the term of this patent is extended or adjusted under 35 U.S.C. 154(b) by 0 days.

(21) Appl. No.: 12/874,693

(22) Filed: Sep. 2, 2010

(65) Prior Publication Data

US 2011/0237481 A1 Sep. 29, 2011

Related U.S. Application Data

(63) Continuation-in-part of application No. 12/105,822, filed on Apr. 18, 2008, now Pat. No. 7,838,484.

(51) Int. Cl.
*C11D 3/33* (2006.01)
*C11D 7/06* (2006.01)

(52) U.S. Cl.
USPC ..... 510/197; 510/220; 510/225; 510/230; 510/233; 510/420; 510/434; 510/435; 510/480

(58) Field of Classification Search ..... 510/197, 510/220, 225, 230, 233, 420, 434, 435, 480
See application file for complete search history.

(56) References Cited

U.S. PATENT DOCUMENTS

| | | | | |
|---|---|---|---|---|
| 4,372,788 | A | 2/1983 | Lancz | 134/4 |
| 4,477,365 | A | 10/1984 | Verboom et al. | 252/156 |
| 4,676,920 | A * | 6/1987 | Culshaw | 510/396 |
| 4,877,691 | A | 10/1989 | Cockrell, Jr. | 428/688 |
| 5,364,551 | A * | 11/1994 | Lentsch et al. | 510/100 |
| 5,380,454 | A * | 1/1995 | Griepenburg et al. | 510/197 |
| 5,480,493 | A | 1/1996 | Harry, Jr. | 134/4 |
| 5,670,473 | A | 9/1997 | Scepanski | |
| 5,858,941 | A * | 1/1999 | Oakes et al. | 510/179 |
| 5,922,667 | A * | 7/1999 | van Baggem et al. | 510/403 |
| 6,784,148 | B2 | 8/2004 | Tadrowski et al. | 510/197 |
| 2003/0022804 | A1 * | 1/2003 | Tadrowski et al. | 510/218 |
| 2003/0176305 | A1 | 9/2003 | Hoyt et al. | |
| 2004/0067866 | A1 | 4/2004 | Griese et al. | |
| 2005/0079992 | A1 | 4/2005 | Smith | |
| 2006/0183656 | A1 * | 8/2006 | Bastigkeit et al. | 510/357 |
| 2008/0274930 | A1 * | 11/2008 | Smith et al. | 510/221 |

FOREIGN PATENT DOCUMENTS

| | | |
|---|---|---|
| EP | 479888 B1 | 4/1992 |
| EP | 0 719 319 B1 | 7/1996 |
| EP | 0 919 612 B1 | 6/1999 |
| GB | 2 294 942 A | 5/1996 |

* cited by examiner

*Primary Examiner* — Charles Boyer
(74) *Attorney, Agent, or Firm* — Andrew D. Sorensen; Amy J. Hoffman

(57) ABSTRACT

Cleaner compositions, associated cleaners, and associated methods are disclosed. The cleaner compositions are capable for use in making thickened cleaners that are capable of removing from vertical and inverted surfaces fresh, greasy soils and baked-on soils encountered in the food service industry. The cleaner compositions include one or more alkalinity sources, one or more chelants, one or more surfactants, one or more thickening agents, one or more buffers, and as a remainder, water. Cleaner compositions of the invention are substantially free of phosphates and have a low caustic content making them user and environmentally friendly. Yet the cleaners of the invention are surprisingly effective at removing tenacious baked-on soils encountered in the food service industry. Compositions of the invention have a viscosity of about 700 cps and are applied using a foaming or misting dispenser. The one or more alkalinity sources may be present in an amount sufficient to provide a free alkalinity (expressible as $Na_2O$) of less than about 1.0 wt % and a total alkalinity (expressible as $Na_2O$) of less than about 2.0 wt %, based on the total weight of the cleaner concentrate. The one or more chelants may be present in an amount up to about 5.0 wt %.

15 Claims, No Drawings

THICKENED OVEN CLEANER COMPRISING A GLUTAMIC ACID SALT OR DISODIUM ETHANOL DIGLYCINE CHELANT

CROSS-REFERENCE TO RELATED APPLICATIONS

This application claims priority to U.S. patent application Ser. No. 12/105,822 filed on Apr. 18, 2008 and entitled "CLEANER CONCENTRATE, ASSOCIATED CLEANERS, AND ASSOCIATED METHODS", now U.S. Pat. No. 7,838,484, the entire disclosure of which is incorporated herein by reference for all purposes.

FIELD OF THE INVENTION

Aspects of embodiments and embodiments of the present invention relate to cleaner compositions, associated cleaners, and associated methods for use in removing from surfaces fresh, greasy soils and baked-on soils commonly encountered in the food service industry. In particular, embodiments of the invention provide viscous or thickened cleaners useful in removing greasy and baked-on soils from vertical or inverted surfaces such as those found in appliances, for example.

BACKGROUND

Greasy soils are often encountered on surfaces (e.g., floors, hoods, appliances—both interior and exterior surfaces, counter tops, shelves, walls, ceilings, and the like) in the food service industry. One type of soil can be referred to as fresh, greasy soil, and the other type of soil can be referred to as baked-on soil. Fresh, greasy soils can result from the presence of fatty soil, which can comprise, for example, a neutral fatty acid triglyceride ester and similar neutral fats, and free fatty acids or salts thereof. The fatty acid salts can be formed from a cation such as sodium, calcium, magnesium, ferric, ferrous, and the like, or combinations thereof.

While existing cleaners may be somewhat effective at removing such soils from horizontal surfaces, they are less effective at removing soils from vertical or inverted surfaces such as found in the interior of ovens or hoods. This less effective cleaning is due in part to reduced contact time. That is, many oven and hood cleaners require a somewhat extended contact time in order to effectively remove the soils and grease from a surface. If the cleaner is applied to a vertical or inverted surface and does not adhere to the greasy or soiled surface for an effective amount of time to act on the grease or soil, it cannot effectively remove the grease or soil.

It would therefore be desirable to provide a cleaner composition, associated cleaners, and associated methods to address the different challenges presented by baked-on soils located on vertical and inverted surfaces encountered in the food service industry. Additionally, a thickened cleaner composition and associated thickened cleaner that is substantially free of phosphorous and/or phosphates and has relatively low caustic content would be desirable.

SUMMARY

Aspects of embodiments and embodiments of the present invention meet these and other needs by providing, without limitation, cleaner compositions, associated cleaners, and associated methods for use in removing from vertical and inverted surfaces fresh, greasy or baked-on soils. Advantageously, such cleaner compositions are formulated to be capable of use for removing soils from vertical and inverted surfaces. In aspects of embodiments, such soils originate from a fat and/or oil from the food service industry.

In aspects of embodiments of the present invention, cleaner compositions include one or more alkalinity sources, one or more chelants, one or more surfactants, one or more thickening agents and, as a remainder, water. The one or more alkalinity sources may be present in an amount sufficient to provide a free alkalinity (expressed as $Na_2O$) of less than about 1.0 wt %, based on the total weight of the cleaner composition, and a total alkalinity (expressed as $Na_2O$) of less than about 2.0 wt %, based on the total weight of the cleaner composition. The one or more chelants may be present in an amount from about 0.1% to 5.0%. The one or more surfactants may be present in an amount from about 0.1 wt % to about 3.0 wt %, based on the total weight of the cleaner composition. The one or more thickening agent may be present in amount from about 0.1 wt % to about 2.0 wt %. The remainder to 100 wt % may be water, based on the total weight of the cleaner composition.

In aspects of embodiments, cleaner compositions further include one or more buffers in an amount sufficient to substantially maintain a pH in range from about 8 to 14. In other aspects, cleaner compositions further include from about 0 wt % to about 1.5 wt % of one or more hydrotropes.

When used, one or more buffers may include a base and a complementary acid. Examples of a base include, without limitation, one or more of a borate (e.g., tetraborate, borax, and the like, or combinations thereof), bicarbonate (e.g., sodium bicarbonate, mixtures of sodium bicarbonate and sodium carbonate, and the like, or combinations thereof), carbonate (e.g., sodium carbonate), and the like, or combinations thereof. Examples of complementary acids include, without limitation, one or more of an alkali metal salt of an inorganic acid, alkali metal salt of an organic acid, or amine salt of an organic acid, such as, without limitation, sodium, potassium or alkanolamine salts of acetic acid, citric acid, lactic acid, tartaric acid, and the like, or combinations thereof. As to an amount of one or more buffers, in one aspect it may be about 0.01 wt % to about 5.0 wt %, based on the total weight of the cleaner composition. In another aspect, the one or more buffers may be about 0.01 wt % to about 4.0 wt %, based on the total weight of the cleaner composition. In yet another aspect, an amount of one or more buffers may be about 0.01 wt % to about 1.0 wt %, based on the total weight of the cleaner composition.

Without limitation, some examples of one or more hydrotropes that may be used include, one or more of xylenesulfonic acid, sodium salt; toluenesulfonic acid, sodium salt; xylenesulfonic acid, ammonium salt; cumenesulfonic acid, sodium salt; cumenesulfonic acid, ammonium salt; xylenesulfonic acid, calcium salt; xylenesulfonic acid, potassium salt; toluenesulfonic acid, potassium salt; glycol; glycol ether; monoproprionate; diproprionate; and the like, or combinations thereof.

Thickeners particularly useful in formulating compositions of the invention are polycarboxylic acids. Compositions of the invention are applied via a foaming sprayer, for example. Ready to use solutions of the invention have a viscosity of greater than about 300 centipoise (cps), greater than about 400 cps, greater than about 500 cps, greater than about 600 cps and greater than about 650 cps. This enhanced viscosity provides a longer cling time allowing the solution to contact a vertical or inverted surface for sufficient time to remove fresh, greasy and/or baked-on soils.

Without limitation, some examples of one or more alkalinity sources include one or more of an alkanolamine, alkali metal carbonate, alkali metal hydroxide, or borate. Further, as well as specific, examples of one or more alkalinity sources are set forth in the description that follows below. As to an amount of one or more alkalinity sources, in one aspect it may be that amount that is sufficient to provide a free alkalinity (expressed as $Na_2O$) from about 0.1 wt % to about 1.0 wt %, based on the total weight of the cleaner composition, and a total alkalinity (expressed as expressed as $Na_2O$) of greater than about 0.1 wt % to about 2.0 wt %, based on the total weight of the cleaner composition. To that end, in one aspect the one or more alkalinity sources may be from about 0.1 wt % to about 2.0 wt %, based on the total weight of the cleaner composition. In another aspect, the one or more alkalinity sources may be from about 0.1 wt % to about 1.5 wt %, based on the total weight of the cleaner composition. In yet another aspect, the one or more alkalinity sources may be from about 0.5 wt % to about 1.5 wt %, based on the total weight of the cleaner composition.

Without limitation, some examples of one or more chelants comprise one or more of an aminocarboxylate, ethanol glycine, polyacrylate, gluconate, glutamate or citrate. Further, as well as specific, examples of one or more chelants are set forth in the description that follows below. As to an amount of one or more chelants, in one aspect it may be from about 0.1 wt % to about 5.0 wt %, based on the total weight of the cleaner composition. In other aspects, the one or more chelants may be from about 0.2 wt % to about 4.0 wt %, based on the total weight of the cleaner composition. In yet other aspects, the one or more chelants may be from about 0.3 wt % to about 3.0 wt %, based on the total weight of the cleaner composition. In still yet other aspects, the one or more chelants may be from about 0.4 wt % to about 2.0 wt %, based on the total weight of the cleaner composition.

Without limitation, some examples of one or more surfactants comprise one or more of an anionic surfactant, nonionic surfactant, cationic surfactant, or amphoteric (or zwitterionic) surfactant. Further, as well as specific, examples of one or more surfactants are set forth in the description that follows below. As to an amount of one or more surfactants, in one aspect it may be from about 0.1 wt % to about 3.0 wt %, based on the total weight of the cleaner composition. In another aspect, the one or more surfactants may be about 0.1 wt % to about 2.5 wt %, based on the total weight of the cleaner composition. In yet another aspect, an amount of one or more surfactants may be about 0.1 wt % to about 2.0 wt %, based on the total weight of the cleaner composition.

Accordingly, aspects of embodiments and embodiments of the present invention are directed to thickened cleaner compositions. Such cleaner compositions include one or more alkalinity sources, one or more chelants, one or more surfactants, one or more thickeners, and optional additional ingredients such as hydrotropes, dyes and fragrances and, as a remainder, water. The one or more alkalinity sources may be present in an amount sufficient to provide a free alkalinity (expressed as $Na_2O$) of less than about 0.9 wt %, based on the total weight of the cleaner composition, and a total alkalinity (expressed as $Na_2O$) less than about 1.5 wt %, based on the total weight of the cleaner composition. The one or more chelants may be present in an amount from about 0.1% to about 5.0%. The one or more surfactants may be present in an amount from about 0.1 wt % to about 3.0 wt %, based on the total weight of the cleaner composition. The thickener may be present in an amount from about 0.1 to about 2.0 wt % of the total weight of the cleaner composition. As stated, optional ingredient such as hydrotropes, dyes, and or fragrances may be included in the invention composition. The remainder to 100 wt % may be water, based on the total weight of the cleaner composition.

Other aspects and embodiments of the present invention are directed to cleaners formulated to be capable of removing baked on soils originating from a fat and/or oil from the food service industry from a vertical or inverted surface. Such cleaners include one or more thickening agents, one or more alkalinity sources, one or more chelants, one or more surfactants, and, as a remainder, water. The one or more alkalinity sources may be from about 0.8 wt % to about 1.4 w %, based on the total weight of the cleaner. The one or more chelants may be from about 0.1 wt % to about 5.0 wt %, based on the total weight of the cleaner. The one or more surfactants may be up to about 3.0 wt. %, based on the total weight of the cleaner. The one or more thickeners may be up to about 2.0 wt. %, based on the total weight of the cleaner. The remainder to 100 wt % may be water, based on the total weight of the cleaner. In some aspects, cleaners further include up to about 1.5 wt % of one or more hydrotropes, based on the total weight of the cleaner. In yet other aspects, the cleaners further include one or more buffers. When used, an amount of one or more buffers may be up to about 5.0 wt %, based on the total weight of the cleaner. Further, as well as more specific, examples of amounts of the number of ingredients are set forth in the description section that follows below.

Still yet other aspects and embodiments of the present invention are directed to cleaners formulated to be capable of removing from a vertical or inverted surface soils originating from a fat and/or oil that may include fats and/or oils from the food service industry. Such cleaners may consist essentially of one or more alkalinity sources, one or more chelants, one or more surfactants, one or more buffers, one or more hydrotropes, one or more thickening agents, and, as a remainder, water. In some aspects, the composition consists of two alkalinity sources from about 0.1 wt % to about 2.0 wt %, based on the total weight of the cleaner, and the a chelant from about 0.1 wt % to about 5.0 wt %, based on the total weight of the cleaner, a combination of three surfactants of up to about 3.0 wt %, based on the total weight of the cleaner, a buffer up to about 5.0 wt %, based on the total weight of the cleaner, a hydrotrope up to about 1.5 wt %, based on the total weight of the cleaner, a thickening agent up to about 2.0 wt %, based on the total weight of the cleaner, and the remainder to 100 wt % may be water, based on the total weight of the cleaner. Further, as well as more specific, examples of amounts of the number of ingredients are set forth in the description section that follows below.

Still yet other aspects and embodiments of the present invention are directed to methods for removing from a surface soils originating from a fat and/or oil that may include fats and/or oils from the food service industry. Such methods include the steps of formulating a cleaner, communicating the cleaner with a soiled vertical or inverted surface, and removing any residue from the surface thereby cleaning the surface. The formulating includes combining a sufficient amount of cleaner composition as described. The contacting of the cleaner with the vertical or inverted soiled surface includes doing so for at least a sufficient amount of time to allow the cleaner to interact with the soil of the soiled surface.

In other aspects, the one or more fats and/or oils of the soil include one or more triglycerides. In yet other aspects, at least a portion of the triglycerides are baked-on.

Still yet other aspects of embodiments and embodiments of the present invention are directed to methods of making a ready to use cleaner composition that is useful for removing from a vertical or inverted surface baked on soils originating from a fat and/or oil that may include fats and/or oils from the food service industry. The method includes providing one or more alkalinity sources, providing one or more chelants, providing one or more surfactants, providing one or more thickening agents, and providing, as a remainder, water. The providing one or more alkalinity sources involves providing an amount sufficient to provide a free alkalinity (expressed as $Na_2O$) of less than about 1.0 wt %, based on the total weight of the cleaner composition, and a total alkalinity (expressed as $Na_2O$) of less than about 2.0 wt %, based on the total weight of the cleaner composition. The providing of the one or more chelants involves providing from about 0.1 wt % to about 5.0 wt %. The providing of one or more surfactants involves providing from about 0.1 wt % to about 3.0 wt %, based on the total weight of the cleaner composition. The providing of one or more thickening agents involves providing from about 0.1 wt % to about 2.0 wt %, based on the total weight of the cleaner composition. The providing, as a remainder of water involves providing to 100 wt % of water, based on the total weight of the cleaner composition.

Embodiments of the present invention include a composition that is substantially free of phosphates, phosphorous, or phosphonates.

DESCRIPTION

As used herein, the term "phosphate-free" refers to a composition, mixture, or ingredient that does not contain a phosphate or phosphate-containing compound or to which a phosphate or phosphate-containing compound has not been added. Should a phosphate or phosphate-containing compound be present through contamination of a phosphate-free composition, mixture, or ingredients, the amount of phosphate shall be less than 0.5 wt %. More preferably, the amount of phosphate is less than 0.1 wt %, and most preferably, the amount of phosphate is less than 0.01 wt %.

As used herein, the term "phosphorous-free" refers to a composition, mixture, or ingredient that does not contain a phosphorous or phosphorous-containing compound or to which a phosphorous or phosphorous-containing compound has not been added. Should a phosphorous or phosphorous-containing compound be present through contamination of a phosphorous-free composition, mixture, or ingredients, the amount of phosphorous shall be less than 0.5 wt %. More preferably, the amount of phosphorous is less than 0.1 wt %, and most preferably, the amount of phosphorous is less than 0.01 wt %.

"Baked on" refers to soils that have either splattered, spilled, or have been aspirated during a baking operation or have spilled, splattered, or been aspirated before a baking operation and have not been removed before commencement of the next baking operation. A soil is said to have been "baked on" if the soil is exposed to baking temperatures for at least a portion of a baking operation up to numerous successive baking operations thereby making the soil much more difficult to remove compared to if it was removed before commencement of a baking operation.

"Cleaning" means to perform or aid in soil removal, bleaching, microbial population reduction, rinsing, or combination thereof.

The terms "thickening agent" and "thickener" are used interchangeably herein. Both terms refer to a compound that when added to a liquid composition causes the viscosity of that composition to substantially increase.

As used herein, weight percent (wt %), percent by weight, % by weight, and the like are synonyms that refer to the concentration of a substance as the weight of that substance divided by the total weight of the composition and multiplied by 100.

As used herein, the term "about" modifying the quantity of an ingredient in the compositions of the invention or employed in the methods of the invention refers to variation in the numerical quantity that can occur, for example, through typical measuring and liquid handling procedures used for making use solutions in the real world; through inadvertent error in these procedures; through differences in the manufacture, source, or purity of the ingredients employed to make the compositions or carry out the methods; and the like. The term about also encompasses amounts that differ due to different equilibrium conditions for a composition resulting from a particular initial mixture. Whether or not modified by the term "about", the claims include equivalents to the quantities.

It should be noted that, as used in this specification and the appended claims, the singular forms "a," "an," and "the" include plural referents unless the content clearly dictates otherwise. Thus, for example, reference to a composition containing "a compound" includes a mixture of two or more compounds. It should also be noted that the term "or" is generally employed in its sense including "and/or" unless the content clearly dictates otherwise.

In the interest of brevity and conciseness, any ranges of values set forth in this specification contemplate all values within the range and are to be construed as support for claims reciting any sub-ranges having endpoints which are real number values within the specified range in question. By way of a hypothetical illustrative example, a disclosure in this specification of a range of from 1 to 5 shall be considered to support claims to any of the following ranges: 1-5; 1-4; 1-3; 1-2; 2-5; 2-4; 2-3; 3-5; 3-4; and 4-5.

The term "substantially free" may refer to any component that the composition of the invention lacks or mostly lacks. When referring to "substantially free" it is intended that the component is not intentionally added to compositions of the invention. Use of the term "substantially free" of a component allows for trace amounts of that component to be included in compositions of the invention because they are present in another component. However, it is recognized that only trace or de minimus amounts of a component will be allowed when the composition is said to be "substantially free" of that component. Moreover, the term if a composition is said to be "substantially free" of a component, if the component is present in trace or de minimus amounts it is understood that it will not affect the effectiveness of the composition. It is understood that if an ingredient is not expressly included herein or its possible inclusion is not stated herein, the invention composition may be substantially free of that ingredient. Likewise, the express inclusion of an ingredient allows for its express exclusion thereby allowing a composition to be substantially free of that expressly stated ingredient.

As used herein the term, "consisting essentially of" in reference to a composition refers to the listed ingredients and does not include additional ingredients that, if present, would affect the cleaning ability of the cleaning composition. The term "consisting essentially of" may also refer to a component of the cleaning composition. For instance, a surfactant package may consist essentially of two or more surfactants and such surfactant package would not include any other ingredients that would affect the effectiveness of that surfactant package—either positively or negatively. As used herein the term "consisting essentially of" in reference to a method of cleaning refers to the listed steps and does not include additional steps (or ingredients if a composition is included in the method) that, if present, would affect the cleaning ability of the cleaning method.

These and other aspects, advantages, and salient features of the present invention will become apparent from the following description and the appended claims.

I. Cleaner Composition

As noted, aspects of embodiments and embodiments of the present invention relate to the cleaner compositions and/or cleaners that may include a number of ingredients. Such ingredients may provide desired characteristics to cleaners. Examples of such ingredients include one or more alkalinity sources, one or more surfactants, and one or more chelants, optionally one or more hydrotropes, one or more buffers, one or more thickening agents, or any combination of any two or more of the preceding. A hydrated thickening agent is included to provide a ready to use solution having a viscosity of about 700 cps. A description of each class of ingredients of the cleaner compositions and/or cleaners follows.

A. One or More Alkalinity Sources

Aspects of embodiments of the present invention relate to the one or more alkalinity sources and cleaners. Suitable alkalinity sources include, but are not limited to, one or more organic alkalinity sources, one or more inorganic alkalinity sources, or combinations thereof. Suitable organic alkalinity sources include, but are not limited to, strong nitrogen bases including, for example monoethanolamine, monopropanolamine, diethanolamine, dipropanolamine, triethanolamine, tripropanolamine, and the like, or combinations thereof. Suitable inorganic alkalinity sources include, but are not limited to, alkali metal hydroxides (e.g., sodium hydroxide, potassium hydroxide, lithium hydroxide, and the like, or combinations thereof), alkali metal carbonates (e.g., sodium carbonate, potassium carbonate, sodium bicarbonate, potassium bicarbonate, sodium sesquicarbonate, potassium sesquicarbonate, and the like, or combinations thereof), alkali metal borates (e.g., sodium borate, potassium borate, and the like, or combinations thereof), alkali metal oxides (e.g., sodium oxide, potassium oxide, and the like, or combinations thereof), and the like, or combinations thereof.

As to an amount of one or more alkalinity sources, in one aspect it may be that amount that is sufficient to provide free alkalinity (expressed as $Na_2O$) of less than about 1.0 wt %, based on the total weight of the cleaner composition, and a total alkalinity (expressed as expressed as $Na_2O$) of less than about 2.0 wt %, based on the total weight of the cleaner composition.

A number of commercially available alkalinity sources may be suitable for use in aspects of embodiments or embodiments of the present invention. Commercially available alkalinity sources may be obtained from a variety of vendors including, but not limited to, PPG Industries (Pittsburgh, Pa.), Dow Chemical Company (Midland, Mich.), and Angus Chemical Company (Buffalo Grove, Ill.). For example, suitable commercially available amino alcohols include, but are not limited to, AMP-95™ primary amino alcohol (2-Amino-2-methyl-1-propanol+5% water) and AMP-90™ amino alcohol (2-Amino-2-methyl-1-propanol+10% water) available from Angus Chemical Company (Buffalo Grove, Ill.). Suitable commercially available caustic soda include, but are not limited to, liquid caustic soda (sodium hydroxide) as 50% (alkali equivalent, wt % $Na_2O$ about 39%) and 73% (alkali equivalent, wt % $Na_2O$ about 57%) solutions in water available from PPG Industries. (Pittsburgh, Pa.). Suitable commercially available alkyl alkanolamines include, but are not limited to, monoethanolamine ($HOCH_2CH_2NH_2$) as MEA grade, MEA LFG grade (an 85% solution of monoethanolamine with 15% water), and MEA ICF grade available from Dow Chemical Company (Midland, Mich.).

In an embodiment the alkalinity source is selected from the group consisting of alkali metal hydroxides and alkanolamines. It is surprising that compositions of the invention are effective at removing baked on soils even though the compositions have a relatively low caustic (alkali metal hydroxide) content and relatively low alkalinity content.

B. One or More Surfactants

Aspects of embodiments of the present invention include one or more surfactants. Suitable surfactants include, but are not limited to, natural surfactants (e.g., surfactants based on natural components such as fatty acids, coconut oil, and the like, or combinations thereof), anionic surfactants, cationic surfactants, nonionic surfactants, amphoteric surfactants (or zwitterionic surfactant), and the like, or combinations thereof. Natural surfactants include, but are not limited to, soaps such as coconut-based soap solutions.

Anionic surfactants include, but are not limited to, one or more of a carboxylate such as, without limitation, alkylcarboxylates (e.g., carboxylic acid and/or its salts), polyalkoxycarboxylates (e.g., polycarboxylic acid and/or its salts), alcohol ethoxylate carboxylates, and the like, or combinations thereof; sulfonate such as, without limitation, alkylsulfonates, alkylbenzenesulfonates (e.g., dodecyl benzene sulfonic acid and/or its salts), alkylarylsulfonates, sulfonated fatty acid esters, and the like, or combinations thereof; sulfate such as, without limitation, sulfated alcohols, sulfated alcohol ethoxylates, sulfated alkylphenols, alkylsulfates, sulfosuccinates, alkylether sulfates, and the like, or combinations thereof. Exemplary anionic surfactants include sodium alkylarylsulfonate, alpha-olefinsulfonate, fatty alcohol sulfates, and the like, or combinations thereof.

Cationic surfactants include, but are not limited to, alkoxylated cationic ammonium surfactants, and the like, or combinations thereof.

Nonionic surfactants include, but are not limited to, alkanolamides, alkyl polyglycocides, and the like, or combinations thereof. Such nonionic surfactants include one or more polyalkylene oxide polymer as a portion of the surfactant molecule. Examples of nonionic surfactants include, without limitation, benzyl-, methyl-, ethyl-, propyl-, butyl- and other like alkyl-capped polyethylene glycol ethers of fatty alcohols, and the like, or combinations thereof; polyalkylene oxide free nonionics such as, without limitation, alkyl polyglycosides, and the like, or combinations thereof; sorbitan esters, sucrose esters, sorbitan esters ethoxylates, sucrose ester ethoxylates, and the like, or combinations thereof; alkoxylated ethylene diamine; alcohol alkoxylates such as, without limitation, alcohol ethoxylates (SURFONIC® L12-6 commercially available from Huntsman), alcohol ethoxylate propoxylates, alcohol propoxylates, alcohol propoxylate ethoxylate propoxylates, alcohol ethoxylate butoxylates, and the like, or combinations thereof; polyoxyethylene glycol ethers, and the like, or combinations thereof; amine oxides, and the like, or combinations thereof; carboxylic acid esters such as, without limitation, glycerol esters, polyoxyethylene esters, ethoxylated and glycol esters of fatty acids, and the like, or combinations thereof; carboxylic amides such as, without limitation, diethanolamine condensates, monoalkanolamine condensates, polyoxyethylene fatty acid amides, and the like, or combinations thereof; and polyalkylene oxide block copolymers including an ethylene oxide/propylene oxide block copolymer such as those commercially available under the trademark PLURONIC® (BASF), and the like, or combinations thereof; other like nonionic compounds; or combinations thereof.

Amphoteric surfactants (or zwitterionic surfactants) include, but are not limited to, imidazoline derivatives, betaines, imidazolines, sultaines, propionates, and the like, or combinations thereof.

Silicone surfactants such as the ABIL® B8852 may also be used.

As to an amount of one or more surfactants, in some aspects it may be may be from about 0.1 wt % to about 3.0 wt %, based on the total weight of the cleaner composition. In other aspects, the one or more surfactants may be from about 0.1 wt % to about 2.5 wt %, based on the total weight of the cleaner composition. In yet other aspects the one or more surfactants may be from about 0.1 wt % to about 2.0 wt %, based on the total weight of the cleaner composition.

A number of commercially available surfactants may be suitable for use in aspects of embodiments and/or embodiments of the present invention. Commercially available surfactants may be obtained from a variety of vendors including, but not limited to, Cognis Oleochemicals LLC and/or Cognis USA (Cincinnati, Ohio), Dow Chemical Company (Midland, Mich.), Huntsman Performance Products (The Woodlands, Tex.), Tomah Products, Inc (Milton, Wis.), Air Products and Chemicals, Inc (Allentown, Pa.), Stepan Company (Northfield, Ill.), Rhodia Inc. (Cranbury, N.J.), Clariant Corporation (Charlotte, N.C.), and Nease Corporate (Cincinnati, Ohio). For example, suitable commercially available amphoteric surfactants include, but are not limited to, MIRANOL® HMA sodium lauroampho acetate (38% solids) and MIRANOL® ULTRA L32 sodium lauroampho acetate available from Rhodia Novecare (Cranbury, N.J.). Suitable commercially available linear alcohol ethoxylates include, but are not limited to, SURFONIC® L12-6 six-mole ethoxylate of linear, primary 10-12 carbon number alcohol available from Huntsman Performance Products (The Woodlands, Tex.). Suitable commercially available alkyl sulfates include, but are not limited to, POLYSTEP® B-29 sodium octyl sulfate available from Stepan Company (Northfield, Ill.). Optionally, suitable commercially available nonionic surfactants include, but are not limited to, oxo-alcohol polyglycol ethers such as GENAPOL® UD 070 C11-oxo-alcohol polyglycol ether (7 EO) available from Clariant Corporation (Cranbury, N.J.). Suitable commercially available linear alkylbenzene sulfonic acids and their salts include, but are not limited to, NAXSOFT® 98S dodecyl benzene sulfonic acid and NAXSOFT® 40S sodium dodecyl benzene sulfonate available from Nease Corporate (Cincinnati, Ohio).

In an aspect of the invention, a combination of surfactants is included in the composition. Such combination of surfactants may be selected from the group consisting essentially of ethoxylated alcohols, alkyl sulfates, and alkyl amphoacetates. In another embodiment such combination of surfactants is selected from the group consisting of ethoxylated alcohols, alkyl sulfates, and alkyl amphoacetates.

C. One or More Chelants (and/or Sequestrants)

Aspects of embodiments of the present invention relate to one or more chelants and cleaner compositions and/or cleaners. To that end, the cleaner compositions and/or cleaners of the present include one or more chelants (used interchangeably herein with one or more sequestrants) that prevent the formation of precipitates or other salts. In another aspect, the one or more chelants also may function to remove baked-on and/or polymerized (e.g., by oxidation, heat, free radical, and the like, or combinations thereof) soils and/or carbonized fats and oils from a surface and suspend these products in a cleaner. Any number of chelants may be used in accordance with aspects of embodiments and/or embodiments of the present invention. Examples of one or more chelants include, but are not limited to, salts of aminocarboxylic acids, glutamic acid and glutamic acid salts, gluconates such as gluconic acid and gluconic acid salts, ethanol diglycinate salts, water soluble acrylic polymers, iminodisuccinate, and the like, or combinations thereof.

Thus, it will be appreciated that suitable chelants for use in the present invention include, but are not limited to, organic compounds, inorganic compounds, or combinations thereof. The number of covalent bonds capable of being formed by a chelant upon a single hardness ion may be reflected by labeling the chelants as bidentate (2), tridentate (3), tetradendate (4), and the like.

In aspects of one embodiment, the one or more chelants are organic. Nonlimiting examples of organic chelants include the salts or acid form of nitriloacetic acid and its derivatives, amino carboxylates, amides, polycarboxylates, salicylates and their derivatives, derivatives of polyamino compounds, and the like, or combinations thereof. Nonlimiting examples of nitriloacetic acid derivatives include, but are not limited to, sodium nitriloacetate, magnesium nitriloacetate, and the like, or combinations thereof. Nonlimiting examples of amino carboxylates include sodium iminosuccinates, and the like, or combinations thereof. Nonlimiting examples of inorganic chelants include sodium aluminosilicates and zeolites.

Nonlimiting examples of polycarboxylates include citric acid and it salts and derivatives, sodium glutarate, potassium succinate, polyacrylic acid and its salts and derivatives, copolymers, and the like, or combinations thereof. Nonlimiting examples of polyamino compounds include ethylene diamine (e.g., ethylenediaminetetraacetic acid {EDTA}, ethylenediaminoetetraproprionic acid), ethylene triamine (e.g., diethyltriaminepentaacetic acid {DTPA}), ethylene tetraamine (e.g., triethylenetetraminoehexaacetic acid {TTHA}), hydroxyethylene diamine (e.g., N-hydroxyethyliminodiacetic acid, nitrolotriacetic acid {NTA}, N-hydroxyethyl-ethylenediaminetriacetic acid {HEDTA}), ethanoldiglycine (EDG a.k.a. hydroxyethyliminodiacetic acid {HEIDA}), diethanolglycine (DEG), 1,3-propylenediaminoetetraacetic acid (PDTA), dicarboxymethyl glutamic acid (GLDA), methylglycine-N—N-diacetic acid (MGDA), iminodisuccinate acid (IDA), their respective alkali metal (e.g., Li, Na, K, and the like, or combinations thereof) salts, their respective ammonium salts, their respective substituted ammonium salts, their derivatives, and the like, or combinations thereof.

Nonlimiting examples of polyacrylic acid and its salts and derivatives include water soluble acrylic polymers. Such polymers include, but are not limited to, polyacrylic acid, polymethacrylic acid, acrylic acid, acrylic acid-methacrylic acid copolymers, polymaleic acid, hydrolyzed polyacrylamide, hydrolyzed methacrylamide, hydrolyzed acrylamide-methacrylamide copolymers, hydrolyzed polyacrylonitrile, hydrolyzed polymethacrylonitrile, hydrolyzed acrylonitrile methacrylonitrile copolymers, and the like, or combinations thereof or copolymers thereof. Water soluble salts or partial salts of these polymers such as their respective alkali metal (e.g., sodium, potassium, or combinations thereof) or ammonium salts can also be used.

In one aspect, the weight average molecular weight of the polymers may be from about 4000 to about 12,000. In another aspect, polymers include, but are not limited to, polyacrylic acid, the partial sodium salts of polyacrylic acid or sodium polyacrylate having an average molecular weight within the range of 4000 to 8000.

In some aspects the one or more chelants may be from about 0.1 wt % to about 5.0 wt %, based on the total weight of the cleaner composition. In other aspects the one or more chelants may be from about 0.2 wt % to about 4.0 wt %, based on the total weight of the cleaner composition. In yet other aspects the one or more chelants may be from about 0.3 wt % to about 3.0 wt %, based on the total weight of the cleaner composition. In still yet other aspects the one or more chelants may be from about 0.4 wt % to about 2.0 wt %, based on the total weight of the cleaner composition.

A number of commercially available chelants may be suitable for use in aspects of embodiments and/or embodiments of the present invention. Commercially available chelants may be obtained from a variety of vendors including, but not limited to, BASF Corporation (Florham Park, N.J.), Dow Chemical Company (Midland, Mich.), and LANXESS Corporation (Pittsburgh, Pa.). For example, suitable commercially available biodegradable methylglycinediacetic acid (MGDA) chelants include, but are not limited to, TRILON® M methylglycinediacetic acid, trisodium salt while aminocarboxylate chelants include, but are not limited to, TRILON® A nitrilotriacetic acid (NTA), TRILON® B ethylenediaminetetraacetic acid (EDTA), TRILON® C diethylenetriaminepentaacetic acid (DTPA), TRILON® M hydroxyethylethylenediaminetriacetic acid (HEDTA) available from BASF Corporation (Florham Park, N.J.). Also suitable commercially available chelants include, but are not limited to, VERSENE® (HEIDA) 2-hydroxyethyliminodiacetic acid, disodium salt from Dow Chemical Company (Midland, Mich.) and dicarboxymethyl glutamic acid (GLDA) from Akzo Nobel. Other suitable commercially available biodegradable chelants include, but are not limited to, BAYPURE® tetrasodium iminodisuccinate and BAYPURE® sodium polyaspartate available from LANXESS Corporation (Pittsburgh, Pa.).

D. One or More Thickening Agents

Ready to use solutions prepared using cleaner compositions of the invention include one or more thickening agents. It has surprisingly been found that suitable thickening agents include polycarboxylic acids such as polyacrylic acid. In comparative tests, other thickening agents such as xanthan gum were tested. The other tested thickening agent resulted in phase separation which was unsuitable. Cleaner compositions including polyacrylic acid, on the other hand, remained monophasic over extended shelf life, provided a suitable viscosity allowing the cleaner to adhere to a vertical or inverted surface for sufficient contact time to remove the particular soil it was attacking. A commercially available polyacrylic acid thickening agent is sold under the trade name CUSTAPOLY from Custom Ingredients located in Chester, S.C. In some aspects the one or more thickening agent may be from about 0.1 wt % to about 2.0 wt %, based on the total weight of the cleaner composition. In other aspects the one or more thickening agent may be from about 0.2 wt % to about 1.8 wt %, based on the total weight of the cleaner composition. In yet other aspects the one or more thickening agent may be from about 0.3 wt % to about 1.6 wt %, based on the total weight of the cleaner composition. In still yet other aspects the one or more thickening agent may be from about 0.4 wt % to about 1.4 wt %, based on the total weight of the cleaner composition.

The ready to use cleaner composition has a viscosity of about 300 to about 2000 cps, about 400 to about 1,200 cps, about 500 to about 900 cps, about 600 to about 800 cps. In an embodiment a sufficient amount of thickening agent is provided in a ready to use solution such that the solution sprayed from a foaming dispenser onto a vertical surface will cling to a vertical surface with a creep rate of less than about 4 cm/second, of less than about 3 cm/second, less than about 2 cm/second, or less than about 1 cm/second.

E. One or More Hydrotropes

Aspects of embodiments and embodiments of the present invention may include one or more hydrotropes in cleaner compositions and/or cleaners. A hydrotrope is a material often used in a cleaner composition and/or cleaner to maintain a single phase neat or aqueous composition or solubilisate (liquid solution). Such hydrotrope may also be used in aspects of embodiments and/or embodiments of the present invention. Hydrotropy is a property that relates to the ability of a material to improve the solubility or miscibility of a substance in liquid phases in which the substance tends to be insoluble. Materials that provide hydrotropy are called hydrotropes and are used in relatively lower concentrations than the materials to be solubilized. A hydrotrope modifies a formulation to increase the solubility of an insoluble substance or creates micellar or mixed micellar structures resulting in a stable suspension of the insoluble substance. The hydrotropic mechanism is not thoroughly understood. Apparently either hydrogen bonding between primary solvent, in this case water, and the insoluble substance are improved by the hydrotrope or the hydrotrope creates a micellar structure around the insoluble substance to maintain the substance in a suspension/solution. According to aspects of embodiments of the present invention, the hydrotropes are useful in maintaining the ingredients of a cleaner composition and/or cleaner in a uniform solution (e.g., solubilisate) both during manufacture and when dispersed at the use location. The one or more surfactants according to aspects of embodiments of the invention alone or when combined with a chelant, may be partially incompatible with an aqueous solution and can undergo a phase change or phase separation during storage of the solution. The hydrotrope maintains a single phase solution (e.g., solubilisate) having the ingredients uniformly distributed throughout a cleaner composition and/or cleaner in an aqueous or non-aqueous form. As to an amount of one or more hydrotropes, in one aspect it may be from about 0 wt % to about 1.5 wt %, based on the total weight of the cleaner composition. In other aspects the one or more hydrotropes may be from about 0.01 wt % to about 1.0 wt % based on the total weight of the cleaner composition. In yet other aspects the one or more hydrotropes may be from about 0.05 wt % to about 0.5 wt % based on the total weight of the cleaner composition. Hydrotropes exhibit hydrotropic properties in a broad spectrum of chemical molecule types. Hydrotropes generally include ether compounds, alcohol compounds, anionic surfactants, cationic surfactants, and the like, or combinations thereof. One hydrotrope usable according to aspects of embodiments of the invention include aromatic sulfonic acid, sulfonated hydrotropes such as C1-C5 substituted benzene sulfonic acid, naphthalene sulfonic acid, and the like, or combinations thereof. Examples of such a hydrotrope are xylene sulfonic acid, toluene sulfonic acid, naphthalene sulfonic acid, salts of xylene sulfonic acid (e.g., xylenesulfonic acid, sodium salt; xylenesulfonic acid, ammonium salt; xylenesulfonic acid, calcium salt; and/or xylenesulfonic acid, potassium salt; cumenesulfonic acid, sodium salt; and/or cumenesulfonic acid, ammonium salt), salts of toluene sulfonic acid (e.g., toluenesulfonic acid, sodium salt; and/or toluenesulfonic acid, potassium salt), salts of naphthalene sulfonic acid, and the like, or combinations thereof.

Also useful are the higher glycols, polyglycols, polyoxides, glycol ethers, propylene glycol ethers, and the like, or combinations thereof. Suitable commercially available biodegradable hydrotropic surfactants include dipropionates such as, but not limited to, MIRATAINE® H2C HA disodium lauriminodipropionate available from Rhodia Novecare (Cranbury, N.J.). Additional useful hydrotropes include the free acids, alkali metal salts of sulfonated alkylaryls such as alkylated diphenyloxide sulfonates, toluene, xylene, cumene and phenol or phenol ether sulfonates or alkoxylated diphenyl oxide disulfonates (DOWFAX® materials); alkyl and dialkyl naphthalene sulfonates, alkoxylated derivatives, and the like, or combinations thereof.

A number of commercially available hydrotropes may be suitable for use in aspects of embodiments and/or embodiments of the present invention. Commercially available hydrotropes may be obtained from a variety of vendors including, but not limited to, Mason Chemical Company (Arlington Heights, Ill.), and Nease Corporate (Cincinnati, Ohio. For example, suitable commercially available hydrotropes include, but are not limited to, NAXONATE® 4L sodium xylene sulfonate, NAXONATE® 4LS sodium xylene sulfonate, NAXONATE® 4LOF sodium xylene sulfonate, NAXONATE® SX sodium xylene sulfonate, NAXONATE® 4AX ammonium xylene sulfonate, NAXONATE® 40SC sodium cumene sulfonate, NAXONATE® 45SC sodium cumene sulfonate, NAXONATE® SC sodium cumene sulfonate, NAXONATE® 4ST sodium toluene sulfonate, NAXONATE® ST sodium toluene sulfonate, and NAXONATE® 4KT potassium toluene sulfonate available from Nease Corporate (Cincinnati, Ohio).

G. One or More Buffers

Aspects of embodiments and embodiments of the present invention may include one or more buffers in the cleaner compositions and/or cleaners. Care must be taken when determining whether to include a buffer into compositions of the invention. Including one or more buffers may result in a pH that is not optimal for a given cleaner composition and may result in a reduction or limitation of the cleaner's effectiveness. For example, cleaners' ingredients may be sensitive to the pH in the surrounding environment. Accordingly, altering the pH of the aqueous environment to which the cleaners' ingredients are introduced regulates the ability of such ingredients to solublize a soil present on a surface.

As a result, the one or more buffers generally maintain the pH of the environment within which the cleaners' ingredients works to a pH of about 8 to about 14. To that end, in aspects cleaner compositions have a pH of about 8 to about 14; in other aspects, a pH of about 9 to about 13; and in yet other aspects, a pH of about 10 to about 13. Generally any one or more buffers that are capable of providing an environment of the proper pH can be used in the processing cleaner compositions and/or cleaners of the present invention. When used, one or more buffers may include a base and a complementary acid. Examples of a base include, without limitation, one or more of a borate (e.g., tetraborate, borax, and the like, or combinations thereof), bicarbonate (e.g., sodium bicarbonate, mixtures of sodium bicarbonate and sodium carbonate, and the like, or combinations thereof), carbonate (e.g., sodium carbonate). Examples of complementary acids include, without limitation, one or more of an alkali metal salt of an inorganic acid, alkali metal salt of an organic acid, or organic amine salt of an organic acid, such as, without limitation, sodium, potassium or triethanolamine salts of acetic acid, boric acid, citric acid, dodecyl benzene sulfonic acid (DDBSA), lactic acid, tartaric acid, and the like, or combinations thereof.

Generally, if pH control is desired to insure a certain activity of cleaner compositions' ingredients and/or cleaners' ingredients, an appropriate type and amount of one or more buffers may be used. As to an amount of one or more buffers, in one aspect it may be up to about 5.0 wt % or more, based on the total weight of the cleaner composition. In another aspect, the one or more buffers may be about 0.01 wt % to about 5.0 wt %, based on the total weight of the cleaner composition. In yet another aspect, the one or more buffers may be about 0.01 wt % to about 3.0 wt %, based on the total weight of the cleaner composition. In still yet another aspect, an amount of one or more buffers may be about 0.01 wt % to about 1.0 wt %, based on the total weight of the cleaner composition. One or more buffers suitable, due to their overall stability and compatibility with cleaner compositions' ingredients and/or cleaners' ingredients include, without limitation, sodium bicarbonate, sodium citrate, and borax. Also, such one or more buffers are readily commercially available, for example sodium citrate from A.E. Staley Division (Decatur, Ill.) of Tate & Lyle PLC.

H. Other Additives

According to aspects of embodiments and embodiments of the present invention, cleaner compositions and/or cleaners may contain one or more additives to provide a desired characteristic to the solution. Suitable additives include, but are not limited to, one or more dyes, pigments, preservatives, antimicrobial agents, corrosion inhibitors, bleaching agents, bleach activators, abrasives, anti-redeposition agents, softeners, conditioners, fragrances and the like, or combinations thereof. In an aspect of one embodiment, the cleaner compositions and/or cleaners comprise at least one dye to provide a desirable color.

Typically, additives, such as those mentioned above, are each individually present in an amount of less than about 2.0 wt %, based on a total weight of the cleaner composition. In aspects of embodiments, each additive, when present, is individually present in an amount ranging from about greater than zero (≧0) to about 0.5 wt %, based on a total weight of the cleaner composition.

A number of commercially available additives may be used in aspects of embodiments and/or embodiments of the present invention. Commercially available dyes suitable for use in the present invention include, but are not limited to, Yellow Dye FD&C #5 available from Pylam Products (Tempe, Ariz.); Blue Pylaklor LX 10092 available from Pylam Products (Tempe, Ariz.); Resorcine Brown 5GM available from Pylam Products (Tempe, Ariz.); and Acid Red #1 available from Keystone Aniline Corporation (Inman, S.C.).

An exemplary cleaner composition of the invention is provided in the table below:

| Description | Ingredient | Amount by weight % |
|---|---|---|
| Solvent | Water Zeolite Softened | 92.3644 |
| Thickening Agent | Polyacrylic acid | 0.75 |
| Chelant | Disodium Ethanol Diglycine, 27% | 2.44 |
| Alkaline Source | NaOH, 50% Liquid | 1.44 |
| Surfactant | Ethoxylated Primary Linear Alcohol C10-C12 with 6 Moles EO | 0.80 |
| Surfactant | Sodium Lauro Ampho Acetate, 40% | 0.83 |
| Surfactant | Alkyl Sulfate, 32% | 0.29 |
| Alkaline Source | Monoethanolamine. 99% | 0.44 |
| Buffer | Citric acid, 50% | 0.085 |
| Hydrotrope | Sodium Xylene Sulfonate, 40% | 0.560 |
| Dye | Acid Red 1 | 0.0006 |

In order to prepare a ready to use composition of the above-provided composition, 0.75 wt % polyacrylic acid (Custopoly,™) thickening agent is allowed to hydrate in 92.36 wt % water. Once hydrated, the remaining ingredients are added to the hydrated thickening agent while mixing. The ready to use composition has a viscosity of greater than about 300 cps, greater than about 400 cps, greater than about 500 cps, greater than 600 cps and greater than 650 cps.

II. Methods of Making the Cleaner Composition

The cleaner composition of the present invention may be prepared using conventional mixing techniques. The ingredients for forming the cleaner composition are combined at about ambient temperature. Compositions of the invention are prepared by first hydrating the thickening agent with solvent, in this case, water. The hydrating step takes at least about 10 minutes, at least about 20 minutes, at least about 30 minutes up to about 1½ hours. In an aspect of the invention, the thickening agent is pumped into a vortex mixer containing water to ensure optimal hydration. Once hydrated, the remaining ingredients are added to the thickening agent while mixing. Cleaner compositions of the invention are prepared by additionally combining: one or more hydrated thickening agents, one or more chelants, one or more alkalinity sources, one or more surfactants, one or more buffers, one or more hydrotropes (when present), and one or more other additives (e.g. when present, one or more dyes, pigments, preservatives, antimicrobial agents, corrosion inhibitors, bleaching agents, bleach activators, abrasives, anti-redeposition agents, softeners, conditioners, fragrances or combinations thereof).

The viscosity of the cleaner composition without the thickening agent is less than about 50 cps, less than about 25 cps, and less than about 10 cps. The complete cleaner composition, including the thickening agent, provides a composition having a viscosity of at least about 300 cps, at least about 400, at least about 500 cps, at least about 600 cps, and at least about 700 cps.

In one aspect of an embodiment, a cleaner composition is prepared using the following steps: (1) forming a premix by adding the thickening agent to at least one solvent (e.g., water) to a mix tank equipped with a stirrer after making sure that the mix tank is clean and allowing the thickening agent to hydrate for up to about 30 minutes, up to about 60 minutes, up to about 75 minutes; (2) adding one or more chelants to the premix while mixing to form a combination; (3) adding at least one or more alkalinity sources to the combination while mixing; (4) adding one or more surfactants to the combination mix tank; (5) when appropriate, adding to the combination mixture one or more buffers; (6) adding to the mix tank one or more hydrotropes, and mixing the mixture; (7) adding an optional dye and mixing; and (8) sampling the resulting mixture to test for desired mixture properties.

In a further desired embodiment of the present invention, a cleaner is prepared using the following steps: (1) forming a premix by adding a thickening agent (polyacrylic acid) to at least one solvent (e.g., water) to a tank, mixing and allowing the thickening agent to hydrate; (2) adding dye to the mix tank; (3) adding at least one or more chelants (e.g., one or more of disodium ethanol diglycine 27%, HEIDA 28% chelant, TRILON® M 40% chelant, DISSOLVINE® GLDA 47% or ACUSOL® 445N chelant) to the premix and mixing to form a combination; (4) adding at least one or more alkalinity sources (e.g., NaOH) to the combination while mixing; (5) letting the mixture stir until the mixture is uniform; (6) forming a combination by adding one or more surfactants to the mix tank (e.g., ethoxylated primary linear alcohol, sodium lauroampho acetate, alkyl sulfate 32%); (7) when appropriate, adding to the combination in the mix tank one or more alkalinity sources (such as monoethanolamine 99%) and combining; (7) adding buffer such as citric acid 50% to the mix tank; (8) adding one or more hydrotropes (e.g., one or more of STEPANATE® SXS hydrotrope, MIRATAINE® $H_2C$ HA 30% hydrotrope, or propylene glycol hydrotrope) and mixing for about 15 minutes; and (10) sampling the mixture to test for desired mixture properties.

III. Methods of Using the Cleaner Composition

The compositions of the present invention may be manufactured as ready to use cleaner compositions.

A. Soil Sources

Aspects of embodiments of the present invention relate to the soils to be removed and the sources of such soils. During food preparation, the use of ovens both at home and in commercial kitchens is standard. Depending upon the cooking process, food may be cooked directly on the oven surface or it may be placed within the oven in a container during cooking. In both processes food products contact and inevitably get baked on to the oven surface. This baked-on soil becomes even more difficult to clean if it is allowed to build up during successive heating cycles within the oven. When spilled, splattered, or aspirated on a surface, changes including polymerization, may occur thereby creating tenacious soils. These same tenacious soils can also be found on exhaust hoods over cooking surfaces in the food service industry.

B. Using Cleaner Generally

Aspects of embodiments of the present invention relate to methods for removing from a surface soils originating from a fat and/or oil from the food service industry. Such method may generally involve, when not already done, formulating a cleaner; communicating the cleaner with the soiled surface; and removing any residue from the surface thereby cleaning the surface. The cleaner is dispensed onto a vertical surface using a foaming or misting sprayer, communicated with the soiled surface for at least a sufficient amount of time to allow the cleaner to interact with the soil of the soiled surface. Then, any residue may be removed from the surface thereby cleaning the surface.

In some instances, cleaners according to aspects and/or embodiments of the present inventions may be "self-working" not having a need for manual scrubbing.

C. Using Cleaner on Appliances Such As Ovens

As one may appreciate, due to the viscosity of the cleaner composition, the cleaner of the invention is suitable for cleaning and degreasing vertical and inverted surfaces. By an inverted surface we may refer to the interior top surface of an oven, the uppermost interior surface of a hood, or the like.

To that end, cleaning systems of the present invention may be used in a variety of applications including, but not limited to, household, commercial, institutional, and industrial applications. Suitable uses include, but are not limited to, cooking surfaces and cookware, such as grill surfaces, toasters, fryers, ovens, hoods, rotisseries, and popcorn poppers, such as those commonly found in the restaurant industry. Cleaners of the invention are particularly suited for cleaning heated appliances having vertical or inverted surfaces.

In an embodiment the cleaner composition is applied to the appliance surface using a foaming or misting applicator. Aspirators, aerosol dispersants, and the like are not preferred when dispensing cleaning compositions of the invention.

Cleaner compositions of the invention are effective at removing greasy soils at any temperature; however, compositions of the invention are increasingly effective at removing such baked on soils at elevated temperatures. In some methods cleaner compositions of the invention are applied to soiled surfaces having temperatures of at least 125 degrees F., at least 140 degrees F., and at least 150 degrees F., at least 175 degrees F., at least 180 degrees F., and at least 200 degrees F.

EXAMPLES

In the following examples, a variety of test and/or methods were used to characterize cleaner compositions. Among these were:

Free Alkalinity (expressible as wt % $Na_2O$) and Total Alkalinity (expressible as wt % $Na_2O$) determination;

Stability determination;

Cling time; and

Soil Removal determination.

Alkalinity Determination

Free alkalinity and total alkalinity, based on the total weight of the solution is determined as follows:

Sample Liquid samples are diluted to prepare a 1 wt % solution of the

Preparation: product diluted to volume with deionized water (DI-water). Liquid samples are mixed thoroughly. Typically, an about 10 g sample is diluted to 1 L using DI water.

Procedure: Manual Titration Method

1. A 10 mL aliquot of the sample solution is pipetted into a 250 mL beaker and 90 mL of DI-water are added.
2. Using a pH meter and magnetic stirrer, titration is carried out with 0.1N hydrochloric acid. When using a pH meter, the endpoint is determined after the pH is reached and holds steadily at the desired pH for at least about 30 seconds.

Calculations: 1. Calculations to report the measured wt % activity of free alkalinity (expressed as wt % $Na_2O$) and wt % total alkalinity (expressed as wt % $Na_2O$) are shown below:

$$\text{wt \% Active Alkalinity (as } Na_2O\text{): wt \% Alkalinity as } Na_2O = \frac{(\text{mL HCl to pH 8.3})(\text{N HCl})(31)(100)}{(\text{g sample titrated})(1000)}$$

$$\text{wt \% Total Alkalinity (as } Na_2O\text{): wt \% Alkalinity as } Na_2O = \frac{(\text{mL HCl to pH 4.0})(\text{N HCl})(31)(100)}{(\text{g sample titrated})(1000)}$$

Cleaner compositions of Examples 1-4 provided in the Table below were made substantially according to the table provided below. Such cleaner compositions were found to have a free alkalinity (expressed as $Na_2O$) ranging from about 0.1 to about 1.0; a total alkalinity (expressed as $Na_2O$) ranging from about 0.1 to about 2.0

Stability Determination

A cleaner composition's stability is determined as follows:

Sample Samples of a product (e.g., ready to use cleaner composition) are

Preparation: obtained. Two to three ounces (2-3 oz.) of the product are transferred to, for example, six on more sample containers. The samples are used for evaluating product stability as follows:

at least one sample for cold temperature (40° F.);

at least one sample for ambient temperature (about 68° F. to 77° F.);

at least one sample for elevated temperature (120° F.);

at least one sample for cycling through temperature zones (120° F. to Ambient); and at least one sample for cycling through temperature zones (0° F. to 40° F. to Ambient).

at least one sample for cycling through temperature zones (40° F. to Ambient).

Procedure: Cold, Ambient, and Elevated Temperature

Each sample exposed to the cold, ambient, and elevated temperatures is examined for any changes (e.g., dye fade, flocculation, crystallization, and the like, or combinations thereof) after 24, 48, and 72 hours and at least weekly, and as frequently as daily, for up to a total of 6 weeks exposure. The cold temperature samples are maintained in a refrigerator set at 40° F. The ambient temperature samples are maintained at a room temperature, about 68° F. to 77° F. The elevated temperature samples are maintained in an oven set at 120° F. Any samples that experience freezing/thawing during cycling are allowed to thaw completely in the refrigerator before evaluation.

Procedure: Cycling Through Temperature Zones

One cycling routine is 120° F. to Ambient, another is 0° F. to 40° F. to Ambient, while yet another is 40° F. to Ambient. The 120° F. to Ambient cycling routine involves holding a sample in an oven set at 120° F. on a first day, then holding the sample at ambient temperature the following day, repeating the cycle throughout the 6 week test period while examining for any changes (e.g., dye fade, flocculation, crystallization, and the like, or combinations thereof). The 0° F. to 40° F. to Ambient cycling routine involves holding a sample in a freezer set at 0° F. on a first day, holding the sample in refrigerator set at 40° F. on a second day, holding the sample at ambient temperature on a third day and repeating the cycle throughout the 6 week test period while examining for any changes (e.g., dye fade, flocculation, crystallization, and the like, or combinations thereof). The 40° F. to Ambient cycling routine involves holding a sample in a refrigerator set at 40° F. on a first day, holding the sample at ambient temperature on a second day and repeating the cycle throughout the 6 week test period while examining for any changes (e.g., dye fade, flocculation, crystallization, and the like, or combinations thereof). The cold temperature samples are maintained in a refrigerator set at 40° F. The ambient temperature samples are maintained at a room temperature, about 68° F. to 77° F. The elevated temperature samples are maintained in an oven set at 120° F. Any samples that experience freezing/thawing during cycling are allowed to thaw completely in the refrigerator before evaluation.

Cleaner compositions of Examples 1-4 provided in the Table below were made substantially according to the table provided below. Such cleaner compositions were found to have acceptable cold stability (40° F.), ambient stability (about 68° F. to 77° F.), elevated stability (about 120° F.), 120° F. to ambient stability, 40° F. to ambient stability, and 0° F. to 40° F. to ambient stability.

Cling Time Determination.

Sample Samples of a product (ready to use cleaner) are

Preparation: obtained. Two to three ounces (2-3 oz.) of the diluted cleaner are transferred to foaming applicators commercially available from Calmar located in (Grandview, Mo.). The samples are used for evaluating cling time as follows:

Cleaner compositions of Examples 1-4 provided in the Table below and a control were applied to a vertical surface. The formulations of the example and the control are provided in the Table below. The examples and the control were tested for vertical cling by measuring the cm/sec traveled after the products were applied to a vertical surface. The control traveled at a rate of 6 cm/sec. whereas Example 1 traveled at a rate of 0.75 cm/sec, Example 2 at 0.26 cm/sec, Example 3 at 0.35 cm/sec and Example 4 at 0.1 cm/sec. Compositions of the invention had a significantly better cling time as compared to the control.

Soil Removal Determination.

Evaluating a cleaner composition's and/or a cleaner's ability to remove a soil involves preparing substrates with a test soil as described below. Then, a candidate cleaner composition or cleaner is applied to a substrate having an appropriately prepared test soil to evaluate ability of the cleaner composition or a cleaner to remove the test soil. Details of the procedures follow:

Stainless steel panels having dimensions of 3"×5" were evenly spread with 0.05 to 1.0 grams of spent oil (obtained from a quick service restaurant and in the present examples resulting from a low linolenic soya frying oil).

The oil was allowed to carbonize by heating the panel to between about 175° F. to about 200° F. on hot plate and held for approximately 15 to 30 minutes depending on the amount of carbonized soil desired. Test samples and controls were applied to the heated (150° F.-200° F.) prepared panel surface(s) and allowed to stand until product dry which occurred after approximately 5-10 minutes provided in the Table below Thereafter the panels were rinsed with tap water, lightly scrubbed and allowed to dry again. Soil removal was observed qualitatively and a rating was applied as follows:

1. No soil removal
2. 0-25% soil removal
3. 25-50% soil removal
4. 50-75% soil removal
5. 75-100% soil removal Cleaner compositions of Examples 1-4 and a control were applied to the soiled panels. The formulations of the examples and the control are provided in the Table below. The examples and the control were tested by rating the % soil removal as described in the method above. The control had an average soil removal rating of 4, whereas Example 1 had an average soil removal rating of 4, Example 2 a rating of 5, Example 3 a rating of 5 and Example 4 a rating of 4. Compositions of the invention performed as well or better than the control at soil removal yet had substantially less total alkalinity as compared to the control.

Cleaner compositions of Examples 1-4 were made according to the table provided below. Such cleaner compositions were found to have a pH value ranging from about 10.2 to about 13.2 and a viscosity ranging from about 400 cps to about 1500 cps when tested on a Brookfield Viscometer RT DV-II using a spindle number 3 at a speed of 50 rpm at a temperature of 77° F.

| Raw Material | Control Percent | Example 1 Percent | Example 2 Percent | Example 3 Percent | Example 4 Percent |
|---|---|---|---|---|---|
| Water Zeolite softened | 83.0073 | 92.3644 | 92.61 | 91.8944 | 92.6 |
| TOTAL WATER | 83.0073 | 92.3644 | 92.61 | 91.8944 | 92.6 |
| NaOH, 50% | 2.438 | 1.44 | 1.44 | 1.8 | 1.10 |
| Sodium tripolyphosphate | 9.996 | | | | |
| Monoethanolamine, 99% | | 0.44 | 0.44 | | 0.34 |
| TOTAL ALKALINITY | 12.434 | 1.88 | 1.88 | 1.8 | 1.44 |
| Disodium ethanol diglycine, 27% | | 2.44 | 2.44 | 2.44 | 2.44 |
| TOTAL CHELANT | | 2.44 | 2.44 | 2.44 | 2.44 |
| Sodium gluconate | 0.2399 | | | | |
| SURFONIC ® L12-6 lauryl alcohol ethoxylates | | 0.8 | | 0.8 | 0.45 |
| MIRANOL ® HMA (sodium lauroamphoacetate, 40%) | | 0.83 | 0.83 | 0.83 | 0.83 |
| POLYSTEP ® B29 (sodium octyl sulfate. 32%) | 1.992 | 0.29 | 0.29 | 0.29 | 0.29 |
| Sodium N-Decyl Diphenylether Disulfonate, 45% | 1.5194 | | | | |
| TOTAL SURFACTANT | 3.5114 | 1.92 | 1.12 | 1.92 | 1.57 |
| STEPANATE ® SXS (sodium xylenesulfonate, 41%) | | 0.5 | 0.56 | 0.56 | 0.56 |
| TOTAL HYDROTROPE | | 0.5 | 0.56 | 0.56 | 0.56 |
| Citric Acid, 50% | | 0.085 | 0.635 | 0.635 | 0.635 |
| TOTAL BUFFER | | 0.085 | 0.635 | 0.635 | 0.635 |
| Dye, Dark Violet LX-10619 | 0.0005 | | | | |
| Acid Red 1 dye | | 0.0006 | 0.0006 | 0.0006 | 0.0006 |
| TOTAL AESTHETICS | 0.0005 | 0.0006 | 0.0006 | 0.0006 | 0.0006 |
| Poly acrylic acid | 0.7997 | | | | |
| CUSTAPOLY ™ polyacrylic acid | | 0.75 | 0.75 | 0.75 | 0.75 |
| TOTAL THICKENING AGENT | 0.7997 | 0.75 | 0.75 | 0.75 | 0.75 |

Other than in the operating examples, or where otherwise indicated, all numbers expressing quantities of ingredients, reaction conditions, and so forth used in the specification and claims are to be understood as being modified in all instances by the term "about." Accordingly, unless indicated to the contrary, the numerical parameters set forth in the following specification and attached claims are approximations that may vary depending upon the desired properties sought to be obtained by an aspect of an embodiment and/or embodiments of the present invention. At the very least, and not as an attempt to limit the application of the doctrine of equivalents to the scope of the claims, each numerical parameter should be construed in light of the number of significant digits and ordinary rounding approaches.

Notwithstanding that the numerical ranges and parameters setting forth the broad scope of the invention are approximations, the numerical values set forth in the specific examples are reported as precisely as possible. Any numerical values, however, inherently contain certain errors necessarily resulting from the standard deviation found in their respective testing measurements.

While typical aspects of embodiment and/or embodiments have been set forth for the purpose of illustration, the foregoing description and the accompanying drawings should not be deemed to be a limitation on the scope of the invention. Accordingly, various modifications, adaptations, and alternatives may occur to one skilled in the art without departing from the spirit and scope of the present invention. It should be understood that all such modifications and improvements have been deleted herein for the sake of conciseness and readability but are properly within the scope of the following claims.

The invention claimed is:

1. A cleaner composition formulated to be capable of removing one or more soils from a surface wherein the one or more soils originate from a fat and/or oil, the cleaner composition comprising:

A) one or more alkalinity sources present in an amount sufficient to provide a free alkalinity (expressed as $Na_2O$) of from about 0.1 wt % to about 1.0 wt %, based on the total weight of the cleaner composition, and a total alkalinity (expressed as $Na_2O$) of from about 0.1 wt % to about 2.0 wt %, based on the total weight of the cleaner composition;

B) from about 0.1 wt % to about 5.0 wt % of one or more chelants selected from the group consisting of glutamic acid salt and disodium ethanol diglycine based on the total weight of the cleaner composition;

C) from about 0.1 wt % to about 3.0 wt % of one or more surfactants selected from the group consisting of an alcohol ethoxylate, an alkyl amphoacetate, and an alkyl sulfate, based on the total weight of the cleaner composition;

D) from about 0.1 wt % to about 2.0 wt % of thickening agent consisting of a polyacrylic acid in order to provide a viscosity of greater than about 300 cps;

E) from about 0.01 wt % to about 5.0 wt % of buffer, based on the total weight of the cleaner composition; and F) from about 0 wt % to about 1.5 wt % of hydrotrope, based on the total weight of the cleaner composition; the remainder to 100 wt % of water, based on the total weight of the cleaner composition.

2. The cleaner composition according to claim 1, wherein the one or more alkalinity sources are selected from the group consisting of one or more of an alkanolamine, alkali metal carbonate, alkali metal hydroxide or borate.

3. A cleaner composition, comprising:

A) one or more alkalinity sources selected from the group consisting of alkanolamines and alkali metal hydroxides present in an amount sufficient to provide a free alkalinity (expressed as $Na_2O$) of less than about 1.0 wt %, based on the total weight of the cleaner composition, and a total alkalinity (expressed as $Na_2O$) of less than about 2.0 wt %, based on the total weight of the cleaner composition;

B) disodium ethanol diglycine present in an amount of at least about 0.1 wt %;

C) from about 0.1 wt % to about 3.0 wt % of one or more surfactants selected from the group consisting of an alcohol ethoxylate, an alkyl amphoacetate, and an alkyl sulfate;

D) from about 0.1 wt % to about 2.0 wt % thickening agent consisting of polyacrylic acid;

E) one more buffers in an amount sufficient to substantially maintain a pH in the range of from about 8 to about 14; and F) from about 0 wt % to about 1.5 wt % of one or more hydrotropes; the remainder to 100 wt % of water, based on the total weight of the cleaner composition.

4. The cleaner according to claim 3, wherein the one or more buffers is selected from the group consisting of borate, bicarbonate, carbonate, an alkali metal salt of an inorganic acid, alkali metal salt of an organic acid, and amine salt of an organic acid.

5. The cleaner composition according to claim 3, wherein the one or more buffers comprises about 0.01 wt % to about 5 wt %, based on the total weight of the cleaner composition.

6. The cleaner composition according to claim 3, wherein the one or more hydrotropes is selected from the group consisting of xylenesulfonic acid, sodium salt; toluenesulfonic acid, sodium salt; xylenesulfonic acid, ammonium salt; cumenesulfonic acid, sodium salt; cumenesulfonic acid, ammonium salt; xylenesulfonic acid, calcium salt; xylenesulfonic acid, potassium salt; and toluenesulfonic acid, potassium salt, higher glycols, polyglycol, polyoxide, glycol ether, propylene glycol ether and diproprionate.

7. The method of claim 3 wherein the composition has a viscosity of greater than 300 cps.

8. A method for removing one or more soils from a surface comprising the steps of:

A) formulating a ready to use cleaner composition according to present claim 1:

B) communicating the cleaner with the soiled surface wherein the one or more soils originate from a fat and/or oil for at least a sufficient amount of time to allow the cleaner to interact with the soil of the soiled surface;

C) removing any residue from the surface thereby cleaning the surface.

9. The method according to claim 8, wherein the fat or oil comprises one or more triglycerides.

10. The method according to claim 9, wherein the triglycerides are baked-on.

11. The method of claim 8 wherein the surface is vertical or inverted.

12. The method of claim 8 wherein communicating the cleaner is accomplished using a foaming applicator.

13. The method of claim 8 wherein communicating the cleaner is accomplished via any means other than aerosol.

14. The method of claim 8 wherein the ready to use cleaner has a viscosity of greater than 600 cps.

15. The method of claim 8 wherein the soiled surface has a temperature of greater than 140 degrees F.

* * * * *